United States Patent [19]

Speckhart

[11] 4,201,162

[45] May 6, 1980

[54] ALUMINUM VALVE SPRING RETAINER

[76] Inventor: Frank H. Speckhart, 534 Dellwood Dr., Knoxville, Tenn. 37919

[21] Appl. No.: 905,445

[22] Filed: May 12, 1978

[51] Int. Cl.[2] ..... F01L 3/10

[52] U.S. Cl. ..... 123/90.67; 123/188 SB; 123/188 VA; 251/322

[58] Field of Search ..... 123/188 VA, 188 GC, 123/188 SC, 188 SB, 90.67, 90.65; 251/322

[56] References Cited

U.S. PATENT DOCUMENTS

| | | | |
|---|---|---|---|
| 1,759,175 | 5/1930 | Vaught | 123/188 GC |
| 1,761,925 | 6/1930 | Lampman | 123/90.67 |
| 1,960,709 | 5/1934 | Olenick | 123/90.67 |
| 2,191,333 | 2/1940 | Willgoos | 123/90.67 |
| 3,222,770 | 12/1965 | Braid | 123/90.67 |
| 3,298,337 | 1/1967 | Thompson | 123/90.67 |
| 3,882,833 | 5/1975 | Longstaff et al. | 123/90.67 |

*Primary Examiner*—Ronald H. Lazarus
*Assistant Examiner*—Jeffrey L. Yates
*Attorney, Agent, or Firm*—Robert S. Alexander

[57] ABSTRACT

Serious racers strive to squeeze as many revolutions per minute as possible out of their engines. They often use exotic metals like titanium in efforts to minimize the weight of some reciprocating parts. Almost exclusively, serious racers use titanium valve spring retainers to obtain higher speeds. This invention relates to an improved valve spring retainer for use in high performance engines. More particularly, it relates to an aluminum valve spring retainer which is lighter and less costly than titanium retainers of approximately equivalent strength.

8 Claims, 5 Drawing Figures

ALUMINUM VALVE SPRING RETAINER

DESCRIPTION OF THE PREFERRED EMBODIMENT

Figure 1:
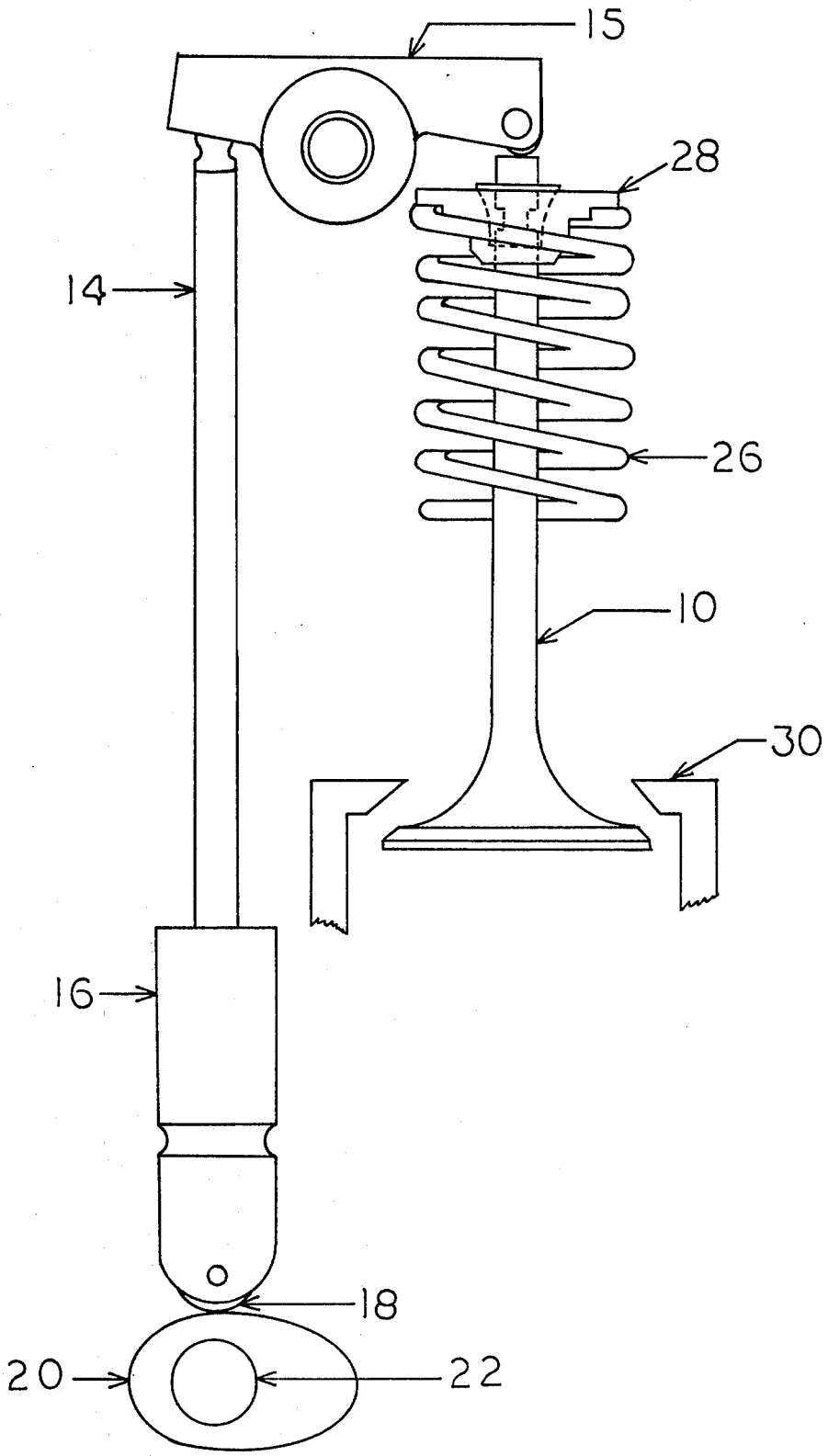
FIG. 1 is a schematic side elevation illustrating the valve lifter mechanism in a high performance push rod engine.
Figure 2:
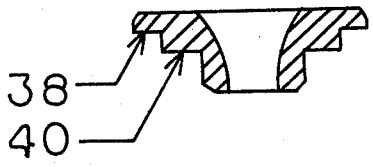
FIG. 2 is a cross-sectional view of an improved valve spring retainer of the type which forms the subject matter of this invention.
Figure 3:
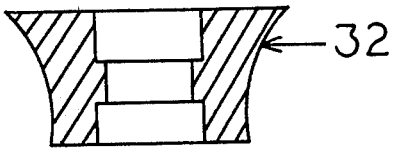
FIG. 3 is a cross-sectional view of the improved keeper.

FIG. 1 illustrates the valve lifter mechanism in a typical internal combustion engine. Valve stem 10 is pivotably connected to rocker arm 15 which is pivotably connected to push rod 14 which engages lifter body 16 terminating in roller 18. Roller 18 bears against cam surface 20 on camshaft 22. Valve springs 24 and 26 bear against valve spring retainer 28 and against engine head 30 urging valve stem 10 upward into the closed position. Valve spring retainer 28 is held in position by keeper 32 comprised of retainer locks 34 and 36.

In racing engines, two valve springs 24 and 26 are used so that the valve can be made to open and shut as quickly as possible, of course, more springs can be used. Since valve springs 24 and 26 are normally very stiff, they exert a great deal of force on thrust surfaces 38 and 40 of valve spring retainer 28 often causing it to fracture at its weak point 42 or extrude the locks through the spring retainer.

Figure 4:
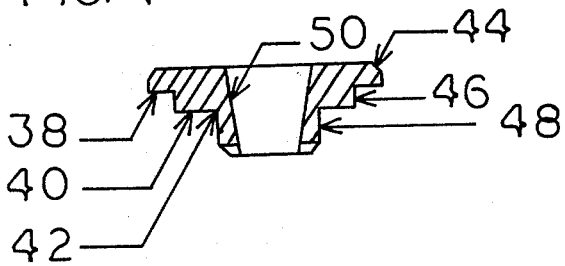
FIG. 4 illustrates the valve spring retainers of the type known to the prior art.
Figure 5:
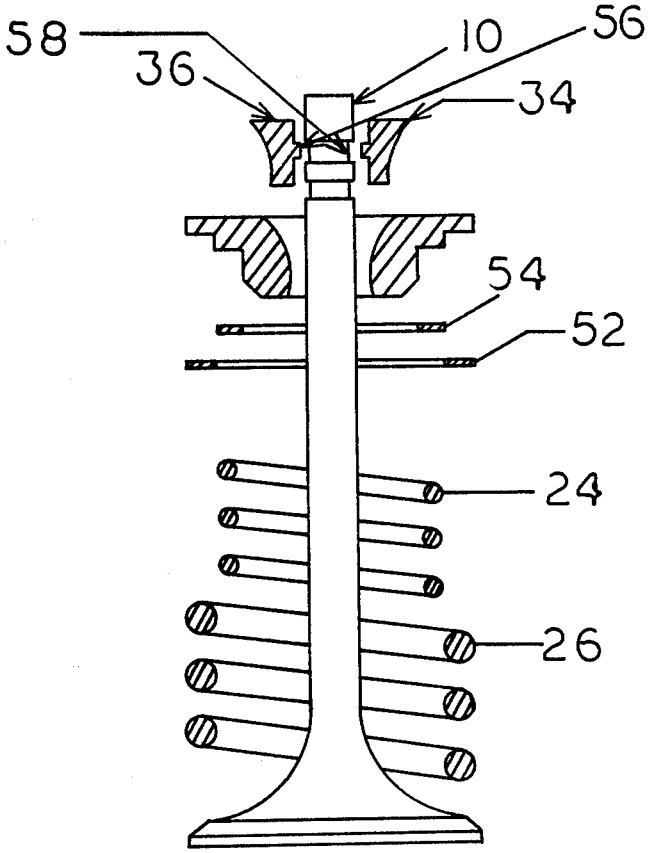
FIG. 5 illustrates an embodiment of the present invention in which steel thrust plates are used to protect the aluminum retainer.

As shown in FIG. 4, the valve spring retainers known to the prior art have a chambered disc portion 44 which joins a thicker intermediate disc portion 46 which in turn is joined to cylindrical body portion 48. The lower face of chamfered disc portion 44 defines thrust surface 38 while the lower face of intermediate disc portion 46 defines thrust surface 40. Tapered bore 50 passes through the centers of discs 44 and 46 and along the centerline of cylindrical body portion 48. As mentioned previously, weak point 42 occurs where intermediate disc portion 46 joins cylindrical body portion 48. The conventional valve spring retainer has a bore having an inner surface which is conical wherein the angle that the generators of the cone define with the centerline of the bore is approximately 7.5° to 10°. In an effort to strengthen valve spring retainers, many other tapers have been used. However, it has been found that when the taper is decreased to 7½°, the extreme forces exerted by the springs on the retainer often actually extrude the keeper through the valve spring retainer.

The valve spring retainer of the present invention differs from those known to the prior art, the angle of taper of the bore is not constant. In particular, the taper angle increases in the regions of the valve spring retainer which are furthest from the springs. More particularly, in a preferred embodiment the initial angle of taper of the bore in the portion adjacent to the valve springs is substantially less than the terminal angle of the taper of the bore in the portion away from the valve springs. In a more preferred embodiment, the initial angle of taper of the bore is between 0° and 10° while the terminal angle of taper is between 10° and 40°. It is further preferred that the interior surface of the valve spring retainer be in the form of a smooth surface of revolution. In a still more preferred embodiment, the local radius of curvature of the generator of the interior surface is substantially constant over at least about 75% of the area of the interior surface. It is greatly preferred that the radius of curvature be constant since this enables the valve spring retainers to be easily formed. It is to be emphasized that the valve spring retainers of the present invention are not merely marginally stronger than conventional designs but are so unexpectedly stronger that aluminum can be substituted for titanium.

It is not essential that the interior surface of valve spring retainer 28 be a surface of revolution, substantial benefits can be obtained if the area of the interior surface increases more rapidly in a portion of the retainer away from the valve springs than in a portion closer to the valve springs.

The retainer locks 34 and 36 which hold the novel valve spring retainer of the present invention in place have exterior surfaces which are congruent with the interior surface of the valve spring retainer and therefore mate with the interior surface of valve spring retainer 28 when inserted therein. Protrusions 56 on retainer locks 34 and 36 engage congruent recess formed in valve stem 10.

In some cases, the ends of valve springs 24 and 26 will gouge thrust surfaces 38 and 40 of valve spring retainer 28 and, over time, weaken it. It has been found that this effect may be avoided by interposing thin annular thrust plates 52 and 54 between valve springs 24 and 26 and thrust surfaces 38 and 40 of valve spring retainer 28. Annular thrust plates 52 and 54 engage thrust surfaces 38 and 40 but may be held in place merely by the force of valve springs 24 and 26. Steel or any other suitably hard material may be used for thrust plates 52 and 54 and a substantial savings in weight realized since the flared interior surface construction of valve spring retainer 28 allows it to be comprised of aluminum.

EXAMPLE

Aluminum valve spring retainers were placed in a testing device having a cylindrical rod 11/32 inches in diameter similar to a valve stem and means for pressing against the thrust surfaces of the retainer while maintaining the retainer in place by means of retainer locks as in an engine. The initial angle of taper of the bore was 5°, the terminal angle of taper of the bore was 25° and the radius of curvature of the interior surface formed by the bore was 1.25 inches. The valve spring retainers failed under an average load of 6964 pounds. Conventional titanium valve spring retainers of similar construction but having an angle of taper of 7½° failed under an average load of 4241 pounds.

As my invention, I claim:

1. An improved valve spring retainer for use in an internal combustion engine having a valve stem, an engine block, a valve spring retainer having a bore encircling a portion of said valve stem, keeper means mounted on said valve stem and engaging said valve spring retainer, valve spring means encircling said valve stem engaging said valve spring retainer and pressing against said engine block, said valve spring retainer characterized in that said bore is a smooth surface of revolution having a first angle of taper at the end of said valve spring retainer adjacent to said valve spring means and a second angle of taper at the end of said valve spring retainer opposite to said valve spring means said second angle of taper being at least about 10° larger than said first angle of taper.

2. The valve spring retainer of claim 1 wherein said first angle of taper is between about 0° and 10° and said second angle of taper is between about 10° and 40° and the difference between said first angle of taper and said second angle of taper is between about 10° and 30°.

3. The valve spring retainer of claim 1 wherein said surface of revolution has a substantially constant local radius of curvature over at least 75% of its area.

4. The valve spring retainer of claim 1 wherein said retainer is comprised of aluminum.

5. In an internal combustion engine of the type having a valve stem, an engine head, valve spring retaining means having a bore defining a smooth surface of revolution encircling a portion of said valve stem, keeper means mounted on said valve stem and engaging the interior surface of said valve spring retaining means formed by said bore, valve spring means encircling said valve stem and engaging said valve spring retaining means and pressing against said engine head, wherein said valve spring retaining means comprises: a valve spring retainer having a bore therethrough the area of said bore engaging said keeper means increasing more rapidly in the portion of said valve spring retainer away from said valve spring than in the portion adjacent to said valve spring and said valve spring retainer having at least one thrust surface formed therein.

6. The device of claim 5 further comprising an annular thrust plate interposed between said valve spring means and said thrust surface.

7. The device of claim 5 wherein the interior surface of said valve spring retainer is a surface of revolution having an angle of taper which is greater in the portion of said valve spring retainer away from said valve spring means than the angle of taper in the portion adjacent to said valve spring means.

8. The device of claim 7 wherein the generator of said surface of revolution has a substantially constant local radius of curvature over at least 75% of the area engaging said keeper means.

* * * * *